United States Patent [19]

Wanke et al.

[11] Patent Number: 4,563,245

[45] Date of Patent: Jan. 7, 1986

[54] PRESS DEVICE, PARTICULARLY FOR THE REMOVING OF WATER FROM A WEB OF PAPER

[75] Inventors: Wilhelm Wanke; Lüdwig Haüser, both of Heidenheim; Karl Steiner, Herbrechtingen, all of Fed. Rep. of Germany

[73] Assignee: J. M. Voith GmbH, Fed. Rep. of Germany

[21] Appl. No.: 609,187

[22] Filed: May 11, 1984

[30] Foreign Application Priority Data

May 13, 1983 [DE] Fed. Rep. of Germany ..... 3317455

[51] Int. Cl.[4] ..... D21F 3/02; D21F 3/06

[52] U.S. Cl. ..... 162/358; 29/116 AD; 100/93 RP; 100/118; 100/153; 162/205; 162/361

[58] Field of Search ..... 162/358, 360.1, 361, 162/205; 100/118, 153, 154, 93 RP; 29/113 AD, 116 AD

[56] References Cited

U.S. PATENT DOCUMENTS

| | | | |
|---|---|---|---|
| 3,726,338 | 4/1973 | Sorenson | 29/116 AD |
| 3,974,026 | 8/1976 | Emson et al. | 162/369 |
| 4,241,482 | 12/1980 | Biondetti | 29/116 AD |
| 4,249,290 | 2/1981 | Lehmann | 29/116 AD |
| 4,357,743 | 11/1982 | Hefter | 29/116 AD |

FOREIGN PATENT DOCUMENTS

| | | | |
|---|---|---|---|
| 1172887 | 8/1984 | Canada . | |
| 1172888 | 8/1984 | Canada . | |
| 2057027 | 3/1981 | United Kingdom | 162/358 |

*Primary Examiner*—S. Leon Bashore
*Assistant Examiner*—K. M. Hastings
*Attorney, Agent, or Firm*—Ostrolenk, Faber, Gerb & Soffen

[57] ABSTRACT

The disclosure concerns a press device for a paper making machine, and particularly concerns an extended nip press. A hollow tubular, stationary support body extends around a supporting beam, which is a flexing beam. Hydraulic piston-cylinder combinations extend between the beam and the supporting body in a press plane. A radially non-displaceable press shoe is supported on the support body and faces toward a counter-roll to define a press nip between them. The outwardly facing surface of the press shoe is concave in the circumferential direction of the support body. The amount of pressure in the hydraulic supporting means determines the press force which prevails in the press zone.

18 Claims, 2 Drawing Figures

PRESS DEVICE, PARTICULARLY FOR THE REMOVING OF WATER FROM A WEB OF PAPER

BACKGROUND OF THE INVENTION

The invention concerns a press device for web-shaped material, and particularly for removing water from a web of paper in a paper machine. More particularly, the invention relates to an extended nip press.

A press device includes a stationary tubular support body that is supported around a stationary beam. A flexible, elastic shell extends around the support body and moves around it. A press shoe in the support body presses the shell against a counter roller or mating roller. The press shoe has a circumferentially elongate concave surface for defining an extended press nip with the counter roller. The press nip is formed relatively long in the circumferential direction. Pressure is exerted on a web of paper, which passes through the press nip together with a felt belt. The web and felt travel over a longer path of travel in an extended press nip than in a traditional roll press that consists of two rolls. In other words, higher "press momentum" (product of the press pressure times the time of pressure) is exerted on the web of paper than in a standard press nip.

Federal Republic of Germany Application DE-OS No. 31 26 492 shows guiding the press shoe for radial displacement directly in a flexing support beam or shows combining the press shoe and the flexing beam into a single structural part. A support body for also guiding the elastic shell outside of the press zone is not present.

In U.S. Pat. No. 4,287,021, a press shoe (formed in two parts) is also guided for radial movement directly within a flexing beam. The pressure within a pressure chamber located between the flexing beam and the press shoe is variable so as to adjust the press force. For the guidance of the elastic shell, which is open toward the outside at both of its edges, a support body is used. However, this reference does not suggest that the body rests on the flexing beam. It is merely guided on the outer sides thereof. Thus, it is not possible in this case to control the sag of the support body by means of the flexing beam.

The present invention is an improvement upon the press device shown in FIG. 5 of Federal Republic of Germany Application DE-OS No. 31 02 526. In that device, a press shoe is arranged on a roll-shaped support body that is in the form of a hollow beam. The press shoe is movable radially relative to the support body. Also, the support body is movable radially with respect to a supporting beam that is capable of flexing. Therefore, hydraulic pressure chambers are necessary between both the flexing beam and the support body supported by the beam and between the support body and the press shoe. This results in a relatively high structural expense. Furthermore, the two pressure-chamber systems, which are arranged in series, may lead to a lack of stability.

SUMMARY OF THE INVENTION

The object of the invention is to avoid the above-described lack of stability at the least possible structural expense.

According to the invention, a beam that extends through the support body is capable of flexing. Hydraulic means support the support body on the beam. The press shoe is fastened to the support body to be immovable radially with respect to the support body. The press force exerted by the hydraulic means is variable to adjust the pressing force in the pressing zone.

The invention is based on the realization that an extended press nip need only have a single hydraulic supporting means arranged between the beam and the support body, and that the supporting means fulfills two functions. On the one hand, it controls sagging of the support body. On the other hand, it adjusts the press force to be applied in the press zone and adapts it to the specific requirements. There is no need for a hydraulic pressure chamber between the support body and the press shoe and no need for radial mobility of the press shoe relative to the support body. The invention also permits the support body to be of relatively light construction, i.e. it need not have flexural rigidity. In operation, the support body, together with the press shoe, rests against the counter-roll. Under the action of the hydraulic supporting device, the support body and the shoe develop a sag which corresponds to the counter-roll. It is beneficial for the support body and the press shoe to assume a uniform sag because the elastic shell can rotate without danger of twisting.

The axial ends of the shell are guided by rotatably mounted tensioning disks. The tensioning disks are mounted on the flexing beam which is disclosed in FIG. 3 of Federal Republic of Germany Application DE-OS No. 31 26 492. Alternatively, it is possible to mount the tensioning side disks on the support body. In this way, the tensioning disks follow radial movement of the support body relative to the flexing beam so that deformation of the edge regions of the elastic shell is kept small.

At each of its axial ends, the support body rests against a disk which is fixed to the flexing beam. These disks (or "slide blocks") can transmit the frictional forces acting on the press shoe in simple fashion from the support body to the beam. The radial mobility of the support body relative to the beam is retained.

The support body may be cooled, particularly by a coolant placed between the support body and the beam. That region is sealed off to contain the coolant. Coolant infeed and removal is from that region. These cooling features can also be used independently of the main concept of the present invention (as, for instance, they can be used in the press device of German Application DE-OS No. 31 02 526). The cooling of the rotating elastic shell is effected predominantly by its contact with the support body. The heat of friction in this connection is given off predominantly to the support body via the lubricant that is present between the shell and the support body, and the heat is not removed as previously by the lubricant. From the support body, the heat of friction passes to a coolant, which is different from the lubricant, and the coolant conducts the heat to the outside. A fluid can be used as the coolant whose specific heat is substantially greater than that of ordinary lubricants. Thus, the total quantity of liquid that is to be circulated is less than previously. The coolant can be passed through channels in the support body or, even more simply, the coolant can be sprayed onto the inside of the support body, particularly if the support body is shell-shaped with thin walls.

Other objects and features of the invention will be described below with reference to the accompanying drawings.

DESCRIPTION OF THE PREFERRED EMBODIMENT

Figure 1:
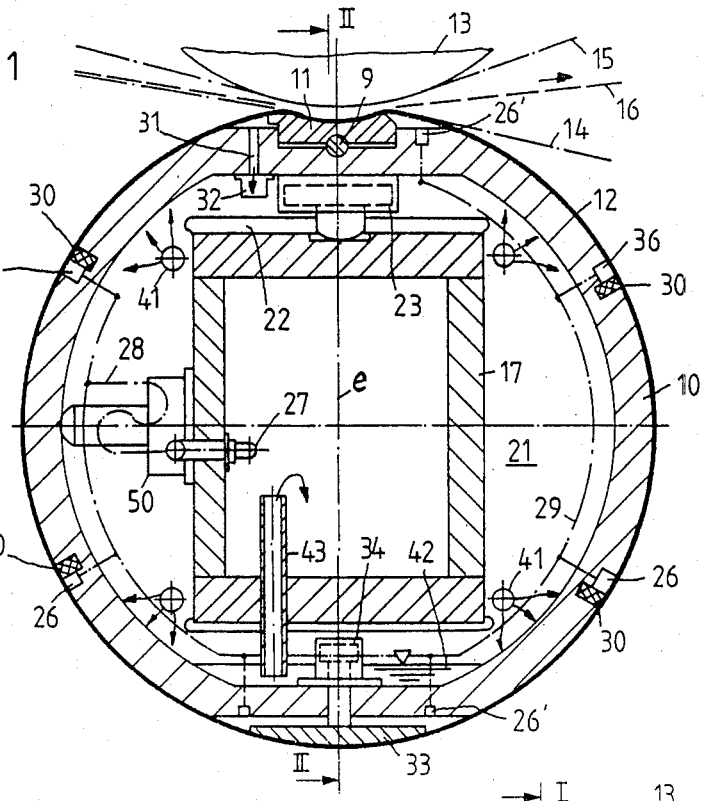
FIG. 1 is a cross-sectional view through a press device, taken along the line I—I of FIG. 2.
Figure 2:
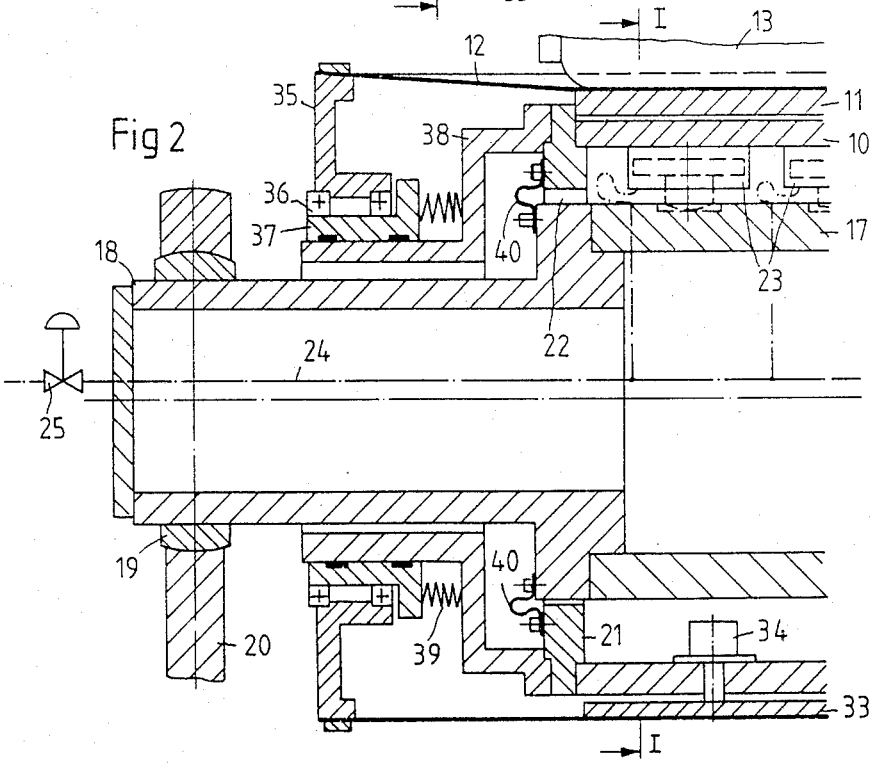
FIG. 2 is a longitudinal sectional view along the line II—II of FIG. 1.

A press device of the invention includes a stationary support body 10 which is developed as a hollow cylindrical body with a continuous, generally cylindrical outer surface. A press shoe 11 is fastened on the outer surface of the support body in a press plane. The shoe is radially fixed on the support body. A radially thin, flexible, elastically deformable, tubular shell 12 is supported to rotate around the stationary support body 10 and the press shoe 11 and to rotate between the shoe 11 and a counter-roll 13. The shell is comprised of a lubricant tight or lubricant blocking plastic, for instance, polyurethane.

The press shoe 11 has a radially outward application surface that is concave circumferentially of the press device. The application surface of the press shoe, together with a part of the circumference of the counter-roll 13, forms a press zone which is extended in the circumferential direction. Besides the shell 12, two felt belts 14 and 15 and a web of paper 16 between the felts pass through this press zone. Water is to be removed from the web of paper in the press zone.

A flexing beam 17 extends lengthwise through the support body 10. The main part of the beam 17 is located within the support body 10. It is preferably of box shape. Hollow journal pins 18 are fastened on and extend axially from the two ends of the main part of the beam 17. In order that the flexing beam 17, 18 be able to bend, the journal pins 18 rest via spherical bushings 19 in a machine frame 20. The beam 17, 18 is prevented from rotating by an anti-turning device, not shown.

A disk 21 is fastened to each of the ends of the support body 10. Each disk has an approximately rectangular cutout 22 that is adapted to the cross-section of the beam 17 on which they are disposed. The cutouts 22 are shaped such that the support body 10, 21, together with the press shoe 11, can be displaced in the direction toward the counter-roll 13 or away from it, and the disks 21 are at the same time secured against rotation. There are a plurality of hydraulic cylinders 23 arranged in an axial row between the beam 17 and the support body 10. These are shown in the press plane at the press shoe and the counter-roll. A pressure conduit 24 with a control valve 25 leads to these cylinders. When the hydraulic cylinders 23 are acted on by pressure, the support body 10, together with the press shoe 11, is pressed against the counter-roll 13. The amount of the pressing force can be controlled by means of the valve 25. If necessary, some of the hydraulic cylinders 23 can be acted on with different pressures if it is desired to exert different pressing forces along the support body which is over the width of the paper web 16.

Instead of the single cylinder 23 shown in the press plane of FIG. 1, two cylinders which can be acted on with different pressures can be arranged circumferentially offset from or even alongside of each other. This permits variation of the distribution of the pressing force within the pressing zone in the direction of travel of the shell 12. For this purpose, it is advisable to rigidly attach the press shoe 11 to the support body 10. In FIG. 1, in contrast, a joint 9 has instead been provided between support body 10 and press shoe 11 so that the press shoe 11 can incline around the axis of that joint and can thus adapt itself more easily to the counter-roll 13.

For lubricating the slide surface between the support body 10 and the shell 12, there are a few lubricating grooves 26, 26' which extend parallel to the axis of the roller and are distributed at intervals over the circumference of the support body 10. The lubricant feed line 27, 28 and 29 delivers lubricant to the grooves 26.

Immediately behind or downstream of the lubricating grooves 26, as seen in the direction of rotation, there may be scraper strips 30, which uniformly distribute the lubricant over the inner surface of the shell 12. The scraper strips 30 are preferably made of felt. This material is particularly good at stabilizing the lubricating film on the very smooth inner surface of the shell 12 which is made of a lubricant-tight plastic, for instance, polyurethane. The scraper strips could also be used in other press devices, for instance, in connection with the devices known from German Application DE-OS No. 31 02 526 or U.S. Pat. No. 4,287,021.

Where the shell 12 enters the press zone, part of the lubricant is scraped off from the shell 12 by the press shoe 11 and this is removed via channels 31, 32. Nevertheless, sufficient lubrication of the application surface of the press shoe 11 must be provided.

For tensioning the flexible shell 12 in the circumferential direction, an axially extending tensioning strip 33 is provided. It applies a slight force against the inside of the shell through the action of hydraulic cylinders 34.

To tension the shell in the axial direction, each of its ends is fastened to a rotatable disk 35. This disk rests, via antifriction bearings 36, on a bearing ring 37 which rests in an axially displaceable, but non-rotatable, manner on a bearing sleeve 38. The bearing sleeve 38 is fastened to the support body 10, 21 and participates in the radial movement of displacement of the body. Compression springs 39 displace the bearing ring 37 axially toward the outside and thus tension the shell 12. Alternatively, the bearing ring 37 can also be arranged directly on the journal pin 18 of the flexing beam 17.

Sealing means 40 are provided at the rectangular cutouts 22 of the disks 21 of the support body 10. These seal off the space that is present between the support body 10 and the flexing beam 17 laterally from the outside. This enables the support body 10 to be cooled by spraying it with a coolant, preferably water. In this way, it is possible to remove at least a large part of the heat of friction which is produced on the slide surface between the shell 12 and the support body 10. A smaller part of that heat has already been removed at 31, 32 along with the lubricant.

Spray pipes 41 feed the cooling liquid (FIG. 1). The cooling liquid collects in the lower region of the space in the support body 10, which forms a sump 42 there. Either a suction pipe 43 cooperates with a vacuum that is produced within the flexing beam 17, 18, or the pressure in the space between the beam 17 and the surrounding support body 10 is raised for conducting the heated cooling liquid through the pipe 43 to the outside of the press device through the beam 17, 18. Instead of the spray pipes 41, cooling channels (not shown) could also be provided within the support body 10. The structural expense for this would, however, be greater.

Under certain circumstances, it must be expected that the support body 10 will sag transversely to the press plane e under the friction forces between the shell 12 and the press shoe 11. Such a sagging would cause the distribution of the press force within the press zone in the direction of travel of the shell to be different, for instance, in the region of the edges of the web of paper, than it is in the central region of the web of paper. This sagging transversely to the press plane can be counteracted by at least one additional cylinder-piston unit 50 which is arranged on the entrance side of the press nip between the beam 17 and the support body 10. On the opposite circumferential side, at least one such cylinder-piston unit (not shown) can also be provided. In the latter case, different pressures are established in the two units, so that the desired sag compensation is obtained. In addition, these units damp any vibrations which may occur.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. A press for web material, comprising:

a counter-roll;

a stationary support body with a continuous, generally cylindrical outer surface, the body being hollow within itself; an elastically deformable, tubular shell supported around the support body and rotatable therearound;

a press shoe attached to the outer surface of the support body and non-movable radially of the support body; the press shoe having a pressing surface which is concavely shaped in the circumferential direction of the support body and which faces outwardly of the support body and faces toward the counter-roll for pressing against the shell and a web between the shell and the counter-roll, thereby defining a press nip in which a pressing force is exerted between the press shoe and the counter-roll;

a flexing beam extending through the hollow support body;

hydraulic supporting means for exerting a force for supporting the support body, the hydraulic supporting means being located between the beam and the support body; means for varying the force exerted by the hydraulic supporting means both for adjusting the pressing force between the press shoe and the counter-roll and for controlling sagging of the support body.

2. The press device of claim 1, wherein the shell has opposite longitudinal ends;

the device further comprising rotatably mounted shell tensioning disks mounted on the support body and rotatable around the support body; the tensioning disks being connected with the ends of the shell; means for biasing at least one of the disks for axially tensioning the shell.

3. The press device of claim 2, further comprising bearing sleeves fastened to the support body and the tensioning disks being on the bearing sleeves.

4. The press device of claim 1, wherein the support body has opposite ends; the device further comprising a respective disk at each end of the support body; the disks being fixed against rotation on the beam; the support body resting at its ends on the disks; the support body being radially displaceable relative to the beam in the press plane passing through and along the press nip.

5. The press device of claim 1, further comprising means for cooling the support body.

6. The press device of claim 5, wherein the beam and the support body are respectively so shaped that a space is defined between them, the support body having opposite ends, the space having lateral sides at the opposite ends; the press device further comprising means at the ends of the support body for sealing off the lateral sides of the space thus defined; the cooling means comprising a coolant in the space for cooling the support body from within the space.

7. The press device of claim 6, wherein the cooling means further comprises feeding means for feeding coolant to the space.

8. The press device of claim 7, further comprising means for removing coolant from the space.

9. The press device of claim 8, wherein the removing means comprises a suction line into the space.

10. The press device of claim 7, wherein there is a lubricant between the shell and the support body.

11. The press device of claim 10, wherein the coolant and the lubricant are different respective fluids.

12. The press device of claim 1, wherein the hydraulic supporting means comprises at least one pressure cylinder-piston combination between the beam and the support body located substantially underneath the press shoe for adjusting sagging of the support body relative to the beam.

13. The press device of claim 12, wherein the hydraulic supporting means comprises a plurality of pressure cylinder-piston combinations between the beam and the support body and all of these combinations being located substantially underneath the press shoe and extending along the axial length of the press shoe for adjusting sagging of the support body relative to the beam along the axial length of the support body.

14. The press device of claim 12, wherein the hydraulic supporting means comprises two pressure cylinder-piston combinations circumferentially offset from each other and adapted for being acted upon by different respective pressures.

15. The press device of claim 1, wherein the press shoe is supported to the support body generally in a press plane, the press device further comprising additional supporting means between the support body and the beam in a plane outside the press plane for operating to reduce the sag of the support body in a direction across the press plane.

16. The press device of claim 15, wherein the additional supporting means are hydraulic.

17. The press device of claim 1, further comprising a scraper strip on the support body and extending toward the shell for rubbing the interior of the shell which is rotating past the support body, the scraper strip being formed of a felt material.

18. The press device of claim 17, further comprising lubricant feed means in the support body for feeding lubricant to the inside of the shell; the scraper strip being disposed directly downstream of the lubricant feed means with respect to the direction of motion of the shell.

* * * * *